US005527242A

United States Patent [19]

Gangloff

[11] Patent Number: 5,527,242

[45] Date of Patent: Jun. 18, 1996

[54] PORTABLE EXERCISE BAR DEVICE

[76] Inventor: Robert B. Gangloff, 54 Dorchester St., Huntington Station, N.Y. 11746

[21] Appl. No.: 337,272

[22] Filed: Nov. 10, 1994

Related U.S. Application Data

[60] Division of Ser. No. 236,349, May 2, 1994, Pat. No. 5,389,055, which is a continuation-in-part of Ser. No. 139,538, Oct. 20, 1993, abandoned.

[51] Int. Cl.[6] ..... A63B 1/00

[52] U.S. Cl. ..... 482/38; 482/140; 482/141; 482/17; 482/104

[58] Field of Search ..... 482/38, 39, 140, 482/141, 142, 17, 104, 904, 40

[56] References Cited

U.S. PATENT DOCUMENTS

| | | | |
|---|---|---|---|
| 201,328 | 3/1878 | Chamberlin | 482/17 |
| D. 290,033 | 5/1987 | Policastro | D21/191 |
| D. 297,957 | 10/1988 | Gordon, III | D21/191 |
| 829,653 | 8/1906 | Kercher | 482/40 |
| 838,539 | 12/1906 | Haye . | |
| 1,286,151 | 11/1918 | Tothill . | |
| 1,410,149 | 3/1922 | Williams et al. . | |
| 2,706,631 | 5/1951 | Holmes | 272/59 |
| 2,932,510 | 4/1960 | Kravitz | 272/62 |
| 3,642,278 | 2/1972 | Hinckley | 272/62 |
| 4,126,307 | 11/1978 | Stevenson | 272/62 |
| 4,201,380 | 5/1980 | Birch | 482/104 |
| 4,227,688 | 10/1980 | Senoh et al. | 272/62 |
| 4,286,782 | 9/1981 | Fuhrhop | 272/117 |
| 4,473,225 | 9/1984 | Miller | 482/40 |
| 4,696,470 | 9/1987 | Fenner | 482/17 |
| 4,749,187 | 6/1988 | Dellinger et al. | 272/103 |
| 4,772,011 | 9/1988 | Guridi | 272/62 |
| 5,156,580 | 10/1992 | Holland et al. | 482/39 |

FOREIGN PATENT DOCUMENTS

| | | |
|---|---|---|
| 862797 | of 0000 | France . |
| 319819 | of 0000 | Italy . |

*Primary Examiner*—Lynne A. Reichard
*Attorney, Agent, or Firm*—Alfred M. Walker

[57] ABSTRACT

A specially designed foldable exercise apparatus is provided for doing pull-ups or chin-ups while the heels of the feet remain on the floor. It includes a chrome-plated steel base with welded vertical bar supports extendable upward on each side of the base, with an uninterrupted space provided between the vertical bar supports for the torso of user's body to be placed therebetween. The vertical supports extend upward with one on each side, approximately midway between a front edge and a rear edge of the base, so that the base extends outward in both directions from the vertical support bars. The pull-up supports are fabricated with apertures or notched vertical supports or hooks on the exterior for placement therein of a horizontal support bar which is movable. The support bar is preferably fabricated of tubular steel with rubber caps on each end to prevent slipping off the support bars. The user lies between the support posts and pulls himself or herself up to the desired level while the heels of the user remain on the floor.

2 Claims, 5 Drawing Sheets

PORTABLE EXERCISE BAR DEVICE

This application is a continuation-in-part of application Ser. No. 08/139,538, filed Oct. 20, 1993, which is based on Applicant's disclosure document No. 294,258 of Oct. 21, 1991.

FIELD OF THE INVENTION

The present invention relates to an exercise apparatus used for doing modified pull-ups and chin-ups. The apparatus is a foldable apparatus for use in a supine position facing up with the heels on the ground.

The apparatus includes a movable horizontal bar which is selectively inserted within corresponding holes of two parallel vertical bars. The horizontal bar contains a pair of trigger handles on each side so that the user can squeeze the trigger handles to remove spring loaded extension pins which extend into the corresponding holes for the two vertical bars.

The vertical bars are each positioned in a fixed or hingable position extending upward from a base permitting the torso of a human body to be positioned therebetween in a supine position, and the horizontal top bar is positioned therebetween so that the horizontal bar may be adjusted while the user is lying in a supine position between the fixed or hingable vertical bars.

To provide stability during use, the vertical bars are centrally located upon the two outside lateral edges of the base to compensate for the angular pull of a user thereby preventing the tipping over of the device while in use.

The apparatus can be folded down for easy carrying. The horizontal chin-up/pull-up bar is dismantled from the vertical bars and placed along the plane of the flat base. The two hinged vertical bars swivel down from the vertical to a horizontal position upon the flat base for easy storage and carrying of the apparatus.

BACKGROUND OF THE INVENTION

Various exercise devices including height adjustment feature for horizontal bars, which are attached to vertical walls or associated structures.

The prior art includes exercising or sport equipment for conducting pull-ups and chin-ups, or horizontal bars for gymnastics and ballet.

Included among the prior art patents are:

| U.S. Pat. Nos. | |
|---|---|
| 290,033 | of Policastro |
| 297,957 | of Gordon |
| 838,539 | of Haye |
| 1,286,151 | of Tothill |
| 1,410,149 | of Williams et al. |
| 2,706,631 | of Holmes |
| 2,932,510 | of Kravitz |
| 3,642,278 | of Hinckley |
| 4,126,307 | of Stevenson |
| 4,227,688 | of Senoh et al. |
| 4,286,782 | of Fuhrop |
| 4,696,470 | of Fenner |
| 4,749,187 | of Dellinger |
| 4,772,011 | of Guridi |
| 5,516,580 | of Holland et al. |

Among foreign patents include France Patent No. 862,797 of Etienne and Italian Patent No. 319,819 of Crespi.

Of the relevant prior art, U.S. Pat. No. 2,932,510 of Kravitz, concerns a portable ballet bar. U.S. Pat. No. Des. 290,033 of Policastro concerns an exercise bar apparatus and U.S. Pat. No. Des. 297,957 of Gordon, III concerns a chin-up bar.

U.S. Pat. No. 838,539 of Haye relates to an amusement device. The apparatus has a horizontal bar (15) supported by a frame and an upright (16). An appropriate means may be employed for the vertical adjustment of the horizontal bar (see page 2, lines 78–94).

U.S. Pat. No. 1,286,151 of Tothill discloses a horizontal bar used on playgrounds and athletic fields. The bar is secured to the uprights by a locking device, which is made of a flat piece bent upon itself to form an eye at its upper end. The lower end is bent to provide two parallel spaced-apart portions to receive a pin.

U.S. Pat. No. 1,410,149 of Williams et al. describes a horizontal bar having frame members to support the bar. The frame members may be folded to release the bar. The apparatus can also be easily stored or packed.

U.S. Pat. No. 3,642,278 of Hinckley relates to a chinning bar apparatus having a bar adjustably attached to a vertical structural member. U-shaped bolts are used to adjust the height of the bar.

U.S. Pat. No. 4,126,307 of Stevenson describes a portable ballet bar. The bar comprises a handrail supported by a pair of adjustable legs. Each leg has a bracing member to secure the bar in a certain position.

U.S. Pat. No. 4,227,688 of Senoh et al. describes an exercise bar comprising a grip rod supported by uprights having chains or cables for anchoring the hooks for supporting the structure.

U.S. Pat. No. 4,286,782 of Fuhrop discloses a multipurpose exercise apparatus having an adjustable horizontal member. The apparatus is easily collapsible and readily storable.

U.S. Pat. No. 5,156,580 of Holland et al. describes a therapeutic traction apparatus for enabling a person to apply gentle traction to the human spine by suspending the entire body vertically by the arms while supporting some of the weight through the legs. The apparatus includes an adjustable hanging bar and support members. The support members are secured to a spreader bar by triangular panel members.

U.S. Pat. No. 4,772,011 of Guridi is for an exercise apparatus installable within a door way. The device is not self standing, and Guridi '011 requires a door jamb as its main structure. It is not adjustable from a position of use. Because it must be installed in a door jamb, the device of Guridi '011 is unsafe and inconvenient for users.

Moreover, changing the height of the horizontal bar in Guridi '011 requires the complex task of unscrewing, removing, and relocating and screwing again the threaded holding knobs.

U.S. Pat. No. 4,696,470 of Fenner describes a dancer's barre structure with a horizontal rail held by the dancer while practicing dance exercise. However, the Fenner '470 structure includes two vertical bars located at the extreme edge of a base, rather than at a central location along the lateral edges, which creates an unstable mechanism unless the user's weight is kept to the base side of the structure.

Also, folding down of the Fenner '470 structure takes up much space, since the hinging is done in the direction of the edge of the base, as opposed to folding towards the middle surface of the base. As a result, for portability purposes, the lateral size of the Fenner structure base must be as large as the size of the vertical upright bars.

Moreover, Fenner cannot be adjusted by the user while in use, since adjusting the height of Fenner '470 structure is cumbersome, as it requires unscrewing and screwing of each of tightened wing nuts into respective holes of the vertical bars.

In addition, the horizontal bar of Fenner is not removable, but is permanently attached to an upper portion of the vertical bars.

U.S. Pat. Nos. 2,706,631 of Holmes and 4,749,187 of Dellinger describe track and field hurdles which are height adjustable. However, both devices are by nature designed to tip over and fall down when struck by a hurdler, in the direction away from the base legs. Therefore, neither Holmes '631 or Dellinger '187 teach a device which can be pulled from below while remaining stable upon the ground.

Moreover, neither the Holmes '631 and Dellinger '187 are designed to fold down for portability, as the vertical upright bars are "L" shaped, with permanent horizontal base leg portions attached to the vertical bars.

In Dellinger '187, movement of the horizontal bar requires also moving downwardly extending vertical supports which are permanently attached to the horizontal bar. In addition, the cumbersome latch mechanism for moving the latch pins on each downward extension into appropriate holes in the vertical bars includes a handle below the horizontal bar which cannot be gripped by the fingers of a user holding the horizontal bar from below.

Furthermore, the spring loaded handles of Holmes '631 are adjacent to each other below and in the vicinity of the horizontal bar, so changing the position cannot be accomplished without moving the palms of the user's hands away from the horizontal bar.

Furthermore, as in Dellinger '187, the handles are also below the horizontal bar, so they cannot be manipulated by the user's fingers while holding the horizontal bar from below.

Moreover, none of the allegedly portable devices of Fenner '470, Dellinger '187 or Holmes '631 can be used by a user lying in a supine position above a base and below a horizontal bar, because all three devices of Fenner '470, Dellinger '187 and Holmes '631 include structural impediments between the horizontal bar above a user and the base below the user.

For example, the hurdles of both Holmes '631 and Dellinger '187 include lower horizontal structural cross bars which interrupt the space between the upper horizontal bar and the base, thus preventing a user from lying supine therebetween.

Furthermore, Holmes also includes a second cross bar below the horizontal bar.

Fenner '470 includes inwardly and upwardly extending angled support brackets, which partially interrupt the space between the horizontal bar and the base, also preventing the user from lying supine therebetween.

Furthermore, the Dellinger '187 device is not readily adjustable from the position of use, as it is evident that vertical adjustment is spring loaded to the main frame, and it requires opposing loads and balanced forces at both ends to prevent binding of the vertical members.

In addition, the Dellinger '187 and Holmes '631 hurdles need to be adjusted by the user while standing up, thereby teaching away from the adjustment of the bar during use. For example, Holmes '631 describes adjusting the hurdle by retracting the pins with one hand and raising the horizontal bar with the other hand.

SUMMARY OF THE INVENTION

Unlike the prior art, the apparatus of the present invention includes a horizontal bar which can be adjusted while in the palm of the hand of the user, since the trigger handles of the horizontal bar can be manipulated by the fingers above each of the handles above the horizontal bar, while holding the bar in the palm of the hand. This occurs because the trigger handles are operated by pulling down the trigger handles which are located above the horizontal bar.

The apparatus can be folded down to a substantially two dimensional device, for easy carrying, when the horizontal chin up/pull up bar is dismantled from the vertical bars and placed along the plane of the flat base.

Thereafter, the two hinged vertical bars swivel down from the vertical position of use to a horizontal position upon the flat base for easy storage and carrying of the apparatus.

Unlike these prior art devices, such as the ballet bar assembly of U.S. Pat. No. 2,932,510 of Kravitz, or the hurdles of Holmes '631 or Dellinger '187, wherein the horizontal bar is moved and tightened before or after exercise from a standing position, the present invention enables the user to custom fit the desirable position of the horizontal bar while the user is already in the supine, facing up position upon the floor.

Moreover, as compared to Kravitz, the hinged, vertical bars of the present invention swivel down conveniently to a horizontal position at rest.

As noted, the present invention is an exercise apparatus used for doing pull-ups/chin-ups. The apparatus is a foldable apparatus for use in a supine position facing up with the heels on the ground. It includes a movable horizontal bar which is selectively inserted within corresponding holes of two parallel vertical bars. The horizontal bar contains a pair of upwardly extending trigger handles to remove spring loaded extension pins which extend into the corresponding holes for the two vertical bars.

In another embodiment, conventional pins can be used to hold the bar in place.

The apparatus can be folded down for easy carrying, unlike the Guridi '011 door jamb structure. The horizontal chin-up/pull-up bar is dismantled from the vertical bars and placed along the plane of the flat base. The two hinged vertical bars swivel down from the vertical to a horizontal position upon the flat base for easy storage and carrying of the apparatus.

The device is also stable for use from below. Since a user doing pull-ups or chin-ups from a supine position pulls down at an angle toward the chin of the user, it is essential that the device not tip over, as the hurdles of Dellinger '187 or Holmes '631 are designed to tip over and fall down when struck by the hurdler. Even the ballet barre structure of Fenner '470 can be tipped over if the user does not stand on the base, since in Dellinger, Fenner and Holmes the vertical bars supporting the horizontal bar are loaded at an edge of the base.

In contrast, the vertical bars of the present invention are located centrally along the edges of the base, so that the base extends in both directions away from the vertical bars. As a result, the force of the user's body pulling upon the horizontal bar will not cause the device of the present invention to tip over and fall down.

OBJECTS OF THE INVENTION

It is an object of the present invention to provide a chin-up/pull-up apparatus which can be folded down to a substantially two dimensional device, for easy carrying.

It is a further object to provide an exercise apparatus which can be dismantled from the vertical bars and placed along the plane of the flat base.

It is yet a further object to provide an exercise apparatus wherein the two hinged vertical bars swivel down from the vertical position of use to a horizontal position upon the flat base for easy storage and carrying of the apparatus.

It is yet a further object of the present invention to provide a apparatus which enables the user to custom fit the desirable position of the horizontal bar while the user is already in the supine, facing up position upon the floor.

It is yet a further object of the present invention to provide hinged, vertical bars which swivel down conveniently to a horizontal position at rest.

It is yet another object to provide an exercise apparatus which includes a horizontal bar which can be moved vertically while the user is in a supine position below the horizontal bar.

It is a further object to provide an exercise apparatus with a horizontal bar which can be adjusted in height while being held in the palm of the hands of a user.

It is yet another object to provide an exercise apparatus with trigger handles above a horizontal bar, so that a user can manipulate the handles with the user's fingers, while the user holds the bar in the palms of the hands of the user.

It is yet another object to provide a stable exercise device which will not tip over while in use.

It is yet another object to improve over the disadvantages of the prior art.

DESCRIPTION OF THE DRAWINGS

Other objects of the present invention will become apparent from the description and the drawings of the present invention, in which.

DETAILED DESCRIPTION OF THE PREFERRED EMBODIMENT

Figure 1:
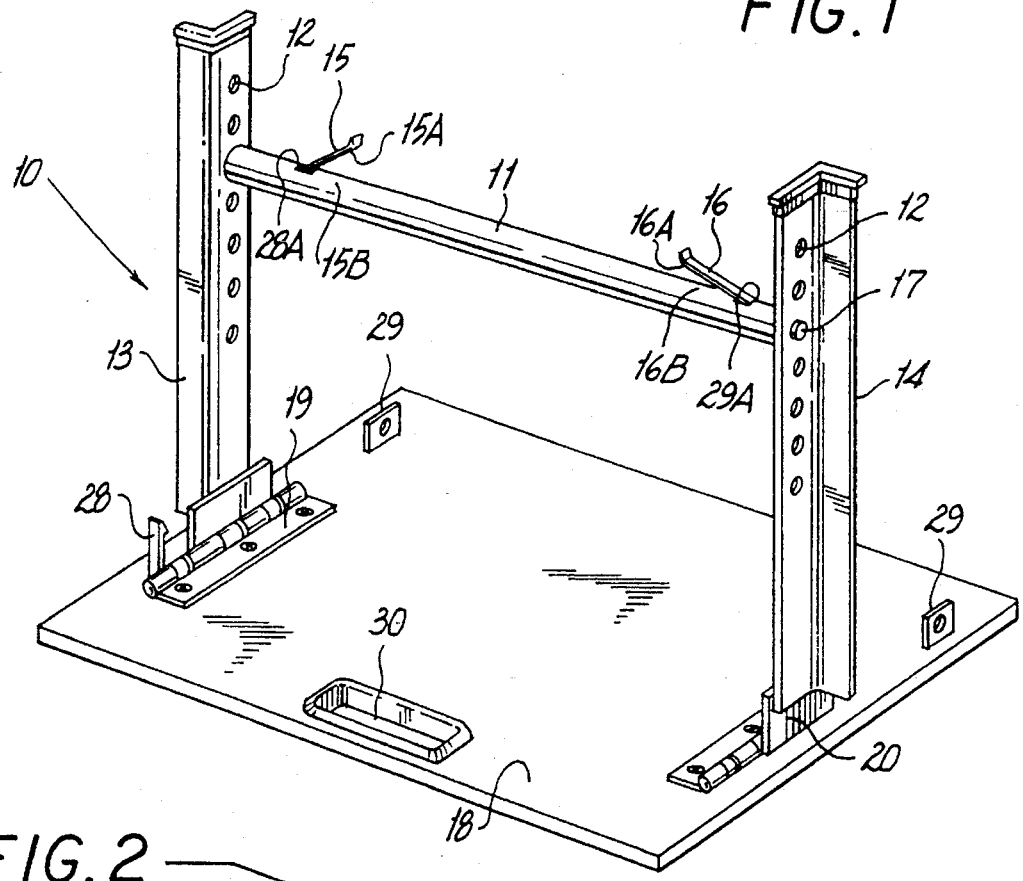
FIG. 1 is an overall perspective view of the assembled preferred embodiment of the apparatus.

As shown in FIGS. 1–9, the present invention includes an exercise apparatus 10 used for doing pull-ups/chin-ups.

Apparatus 10 is a foldable apparatus for use in a supine position facing up with the heels on the ground. It includes movable horizontal bar 11 which is selectively inserted within corresponding aperture holes 12 of parallel vertical bars 13 and 14.

Vertical bars 13, 14 extend upward in respective predetermined positions from horizontal base 18 for permitting the torso of a user to be placed therebetween, and horizontal bar 11 is positioned therebetween a height above base 18 to permit the torso of the user to extend uninterrupted between horizontal bar 11 and base 18.

Moreover, for stability, vertical bars 13, 14 extend up from base 18 along each lateral edge of base 18, at approximately midpoint between the center of base 18 to provide stability and prevent base 18 from tipping over while the user pulls horizontal bar 11 down at an angle toward to user's chin. While it is preferable to be centrally located, bars 13, 14 may be placed from ¼ to ¾ along the lateral edges of base 18, so that base 18 extends significantly out in both directions away from vertical bars 13, 14.

For further stability, vertical bars 13,14 may be moved up from a flat horizontal position of non-use from base 18, but such movement is restricted by contact of the bottom of vertical bars 13,14 upon the surface of base 18.

Horizontal bar 11 contains a pair of trigger handles 15 and 16 to remove spring loaded extension pins 17 which pins 17 extend into corresponding aperture holes 12 for vertical bars 13 and 14. Trigger handles 15, 16 extend upward from horizontal bar 11 near the ends thereof, so that the user can pull down upon trigger handles 13, 14 with the user's fingers while holding horizontal bar 11 in the palms of the user's hand. Alternatively, conventional pins can be used.

Apparatus 10 can be folded down for easy carrying. Horizontal chin-up/pull-up bar 11 is dismantled from vertical bars 13 and 14 and placed along the horizontal plane of flat base 18. Base 18 is optionally portable or attachable to a floor. Vertical bars 13 and 14 are affixed and attached to hinges 19 and 20, and swivel down from a vertical to a horizontal position upon base 18 for easy storage and carrying of apparatus 10. After vertical bars 13 and 14 are folded down to base 18, vertical bars 13 and 14 are held secured in place by means of locking tabs 28 extending up from base 18 in the vicinity of hinges 19 and 20.

Apparatus 10 is a specially designed exercise apparatus used for doing pull-ups or chin-ups from a semi-supine position wherein the torso of the user is elevated from horizontal bar 11 while the heels of the user are on the floor.

Preferably, apparatus 10 is fabricated with steel or steel alloy. Apparatus 10 includes chrome-plated or baked enamel steel base 18 measuring approximately 12 inches by 36 inches with vertical bars 13 and 14 on each side of base 18.

Vertical support bars 13 and 14 preferably measure approximately 34 inches high, with one bar on each side. Vertical support bars 13 and 14 may be fabricated with notched vertical support hooks 21 with notches 22 on vertical bars 13 and 14 for placement of horizontal support bar 11 therein.

Horizontal support bar 11 may also be fabricated of tubular steel measuring approximately 30 to 40 inches long and one to one and one-half inches in diameter with caps 23, such as rubber or steel heads, and end rod members 24 on each end to prevent slipping off of horizontal support bar 11 from within notches 22.

In use, the user lies between vertical support bars 13 and 14 and pulls the upper body of himself or herself up to the desired level.

In particular, FIG. 1 shows an overall perspective view of the assembled preferred embodiment of portable, foldable exercise apparatus 10.

Figure 2:
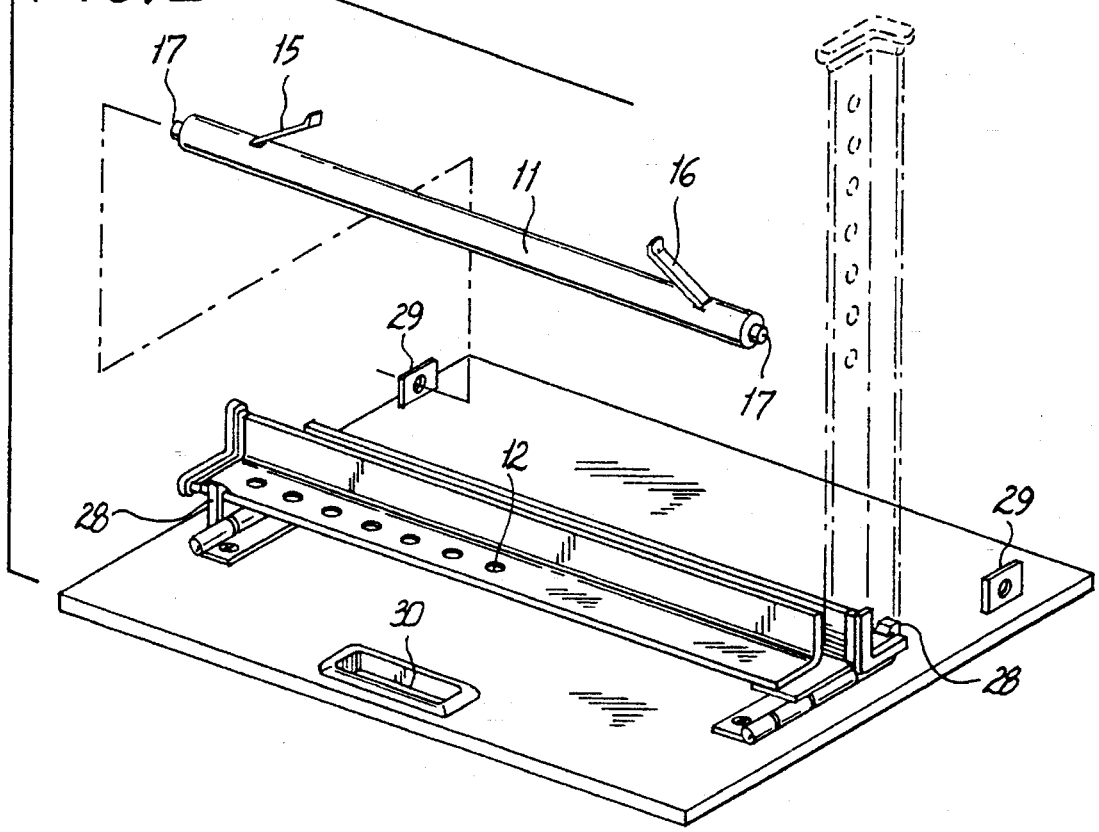
FIG. 2 is an overall perspective of the preferred embodiment with legs collapsed down for storage, and chinning bar exploded from storage securement tabs.

FIG. 2 shows the preferred embodiment of apparatus 10 with vertical frame bars 13 and 14 collapsed down for storage. FIG. 2 also reveals spring-loaded pins 17 for attachment of horizontal bar 11 to upright vertical frame bars 13 and 14.

Figure 3:
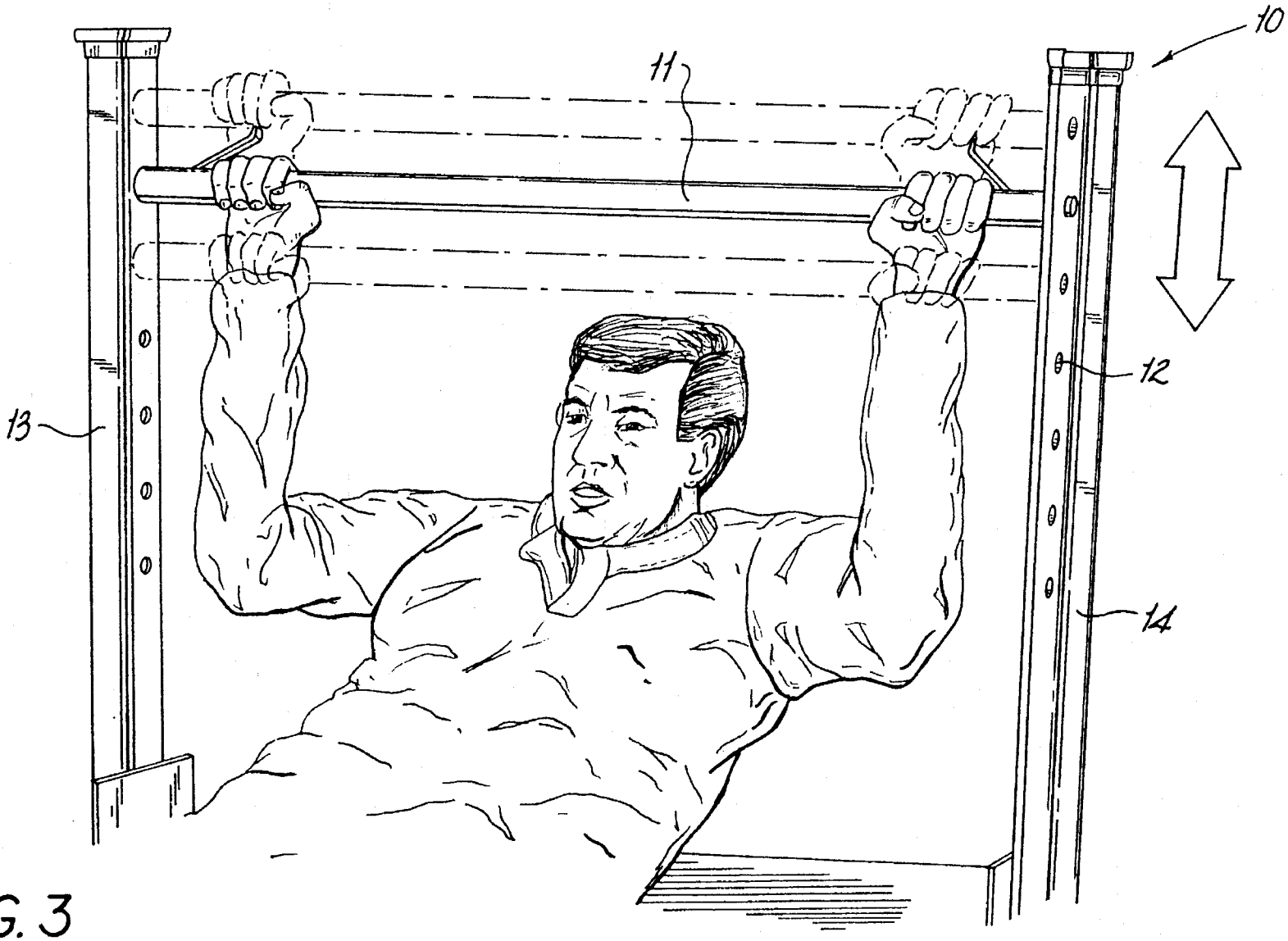
FIG. 3 is a perspective view of preferred embodiment illustrating adjustability of chin-up bar by user while exercising.

FIG. 3 illustrates the adjustability of chin-up bar by user while exercising.

Figure 4:
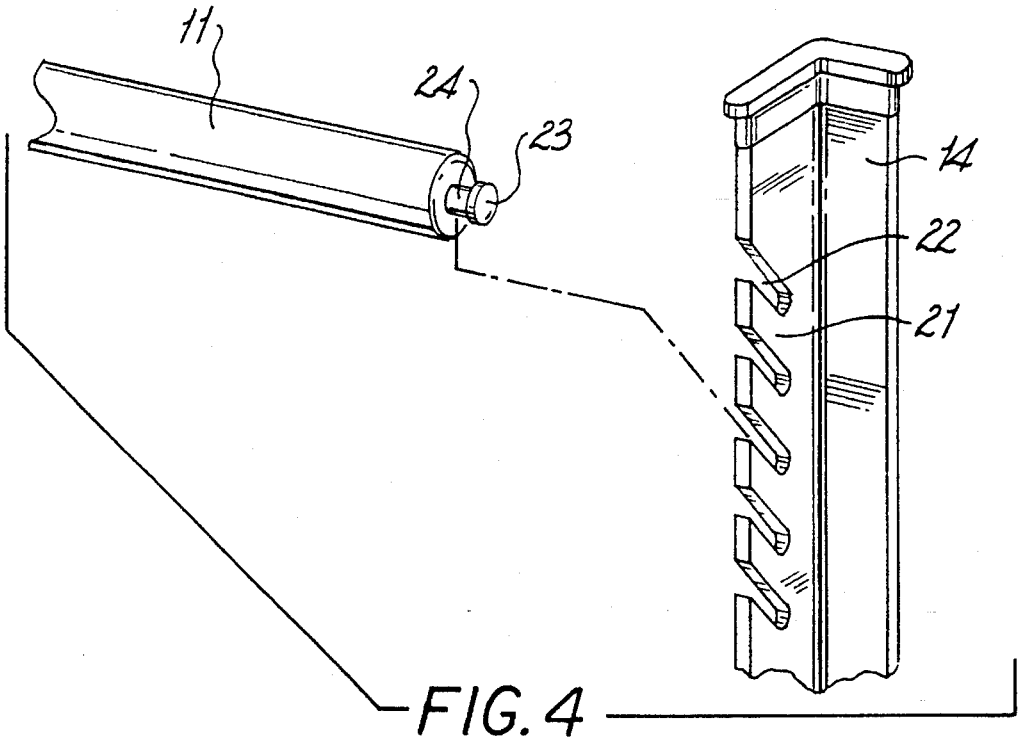
FIG. 4 is a local perspective view of alternate leg embodiment having oblong slots to accept pins on chin-up bar.

FIG. 4 shows an alternate vertical bar embodiment of the apparatus having oblong slots 22 to accept extension end rods 24 on horizontal chin-up bar 11. As also shown in FIG. 4, handle chip-up bar 11 has a first cross sectional diameter greater than a second cross sectional diameter of extension end rods 24. A further pair of extension pins 23 extends from respective end rods 24 at outer ends thereof. Extension pins 23 have a third cross sectional diameter greater than the second diameter of extension end rods 24 to prevent extension end rods 24 from falling out of respective slots 22 of vertical frame members 13, 14.

Figure 5:
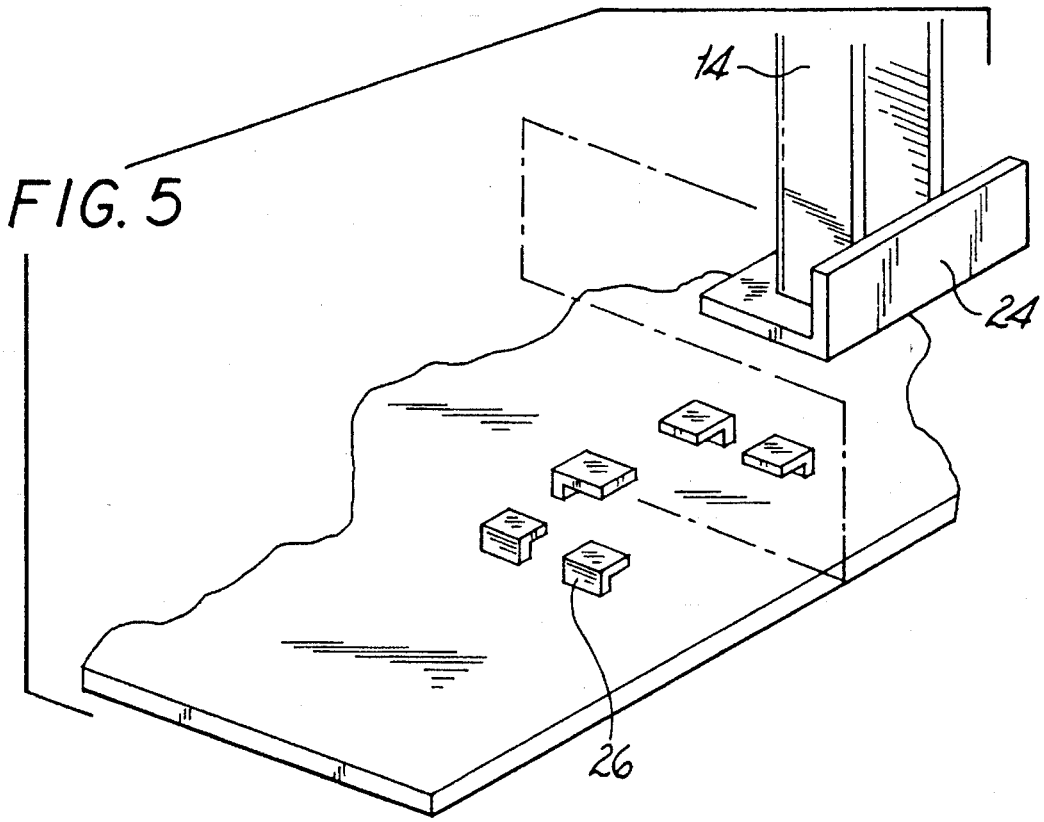
FIG. 5 is a local perspective view of alternate, unhinged leg securement means utilizing a leg plate sliding under bent tabs.
Figure 7:
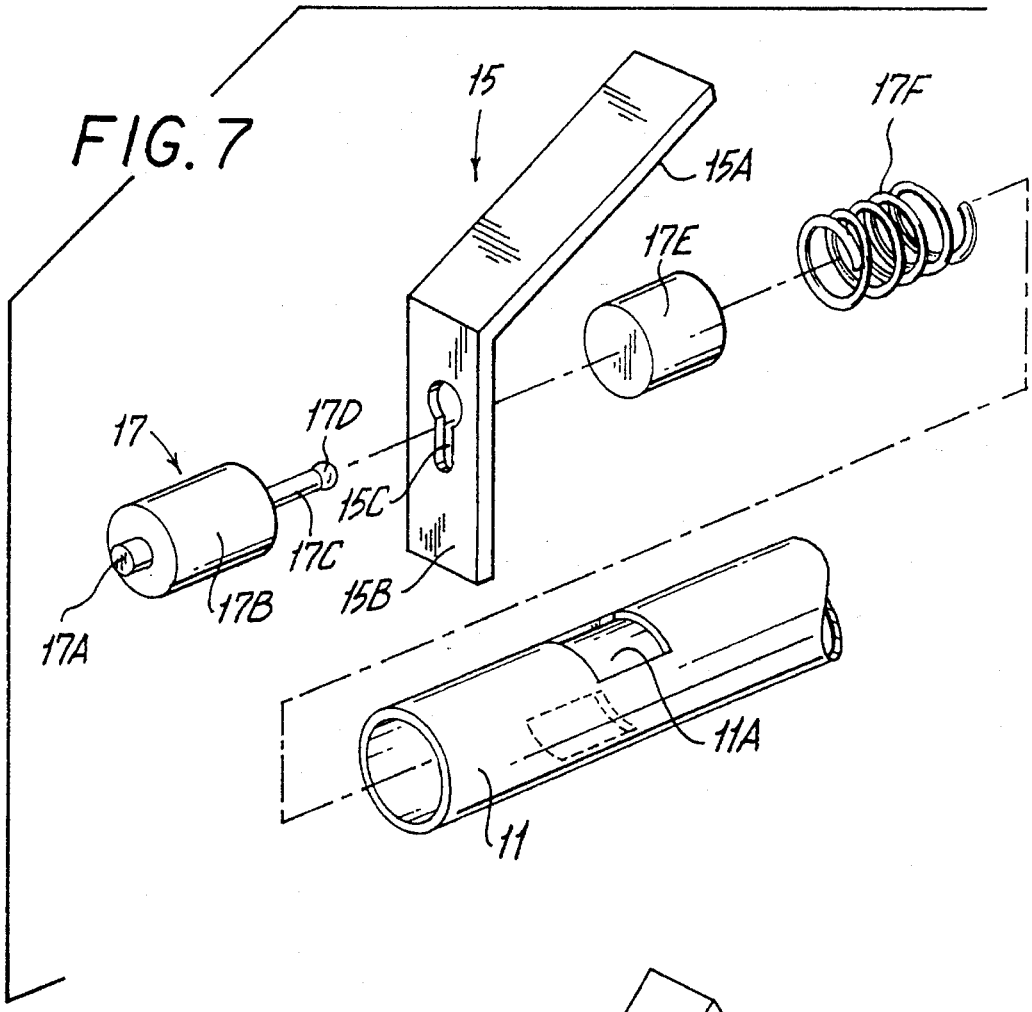
FIG. 7 is an exploded perspective view of the parts shown in FIG. 6.
Figure 6:
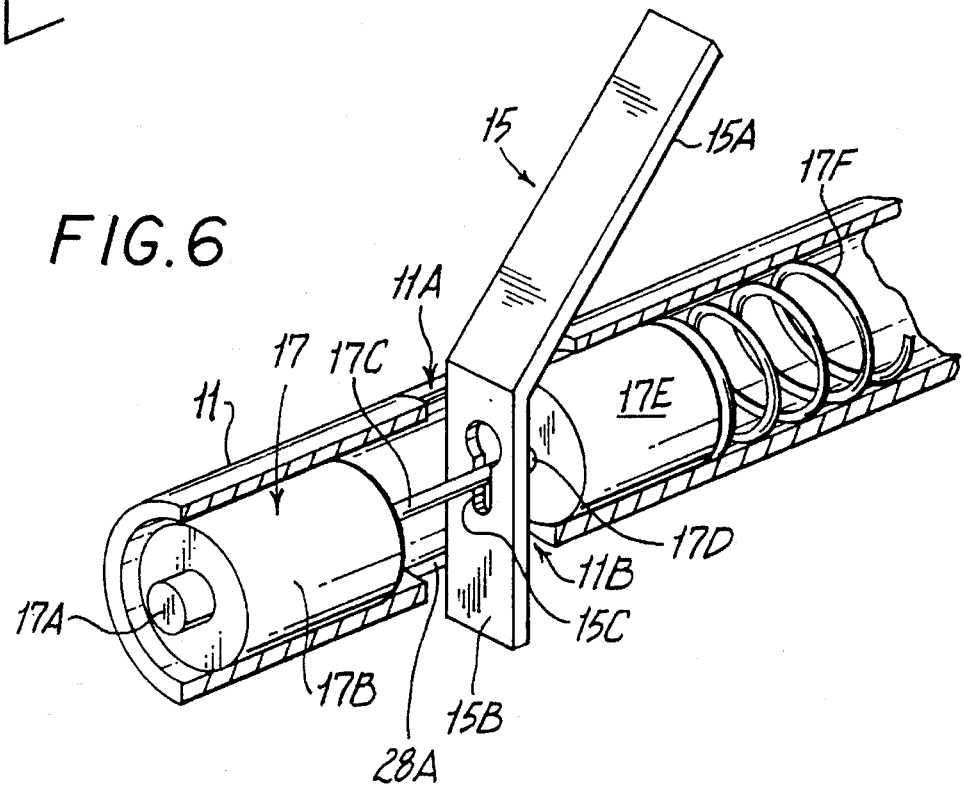
FIG. 6 is a close up perspective view in partial section of the left side adjustment handle portion of the device.
Figure 9:
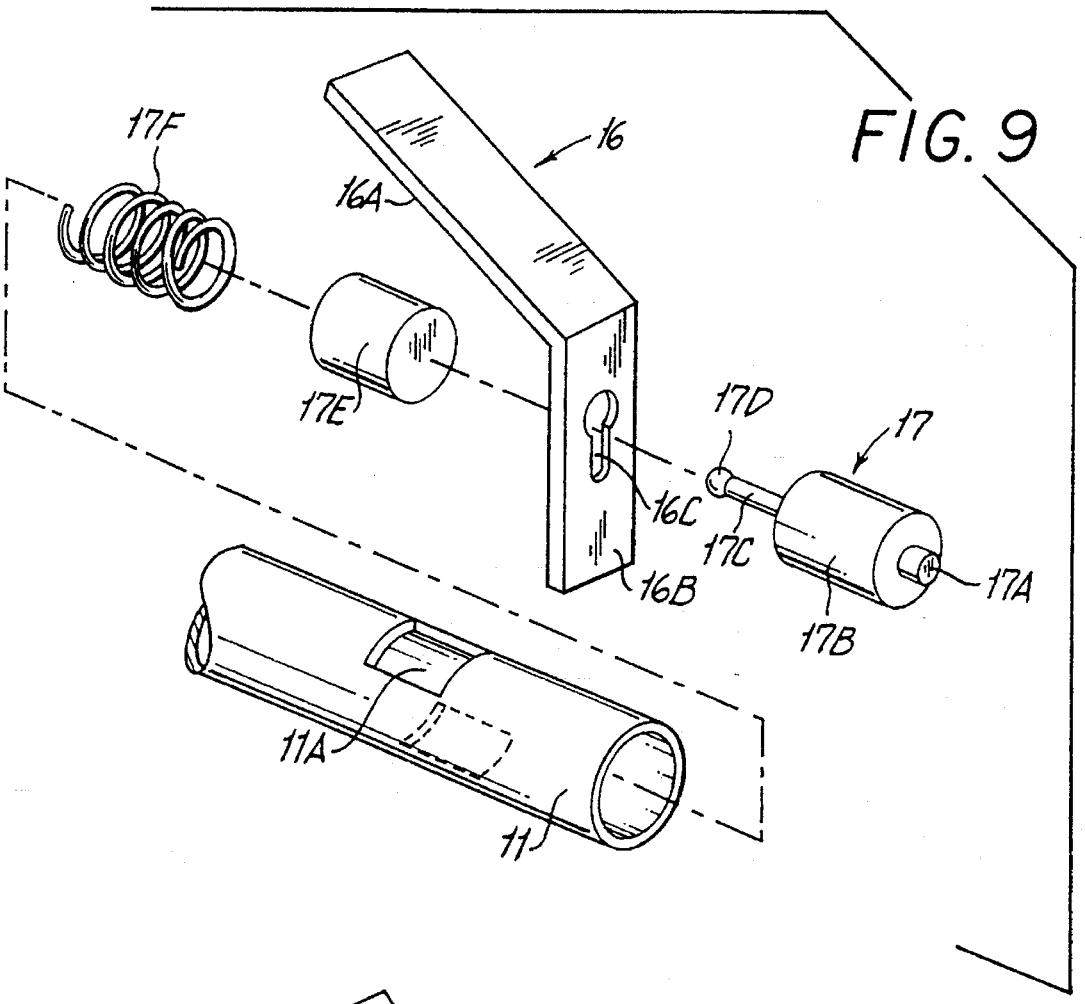
FIG. 9 is an exploded perspective view of the parts shown in FIG. 8.
Figure 8:
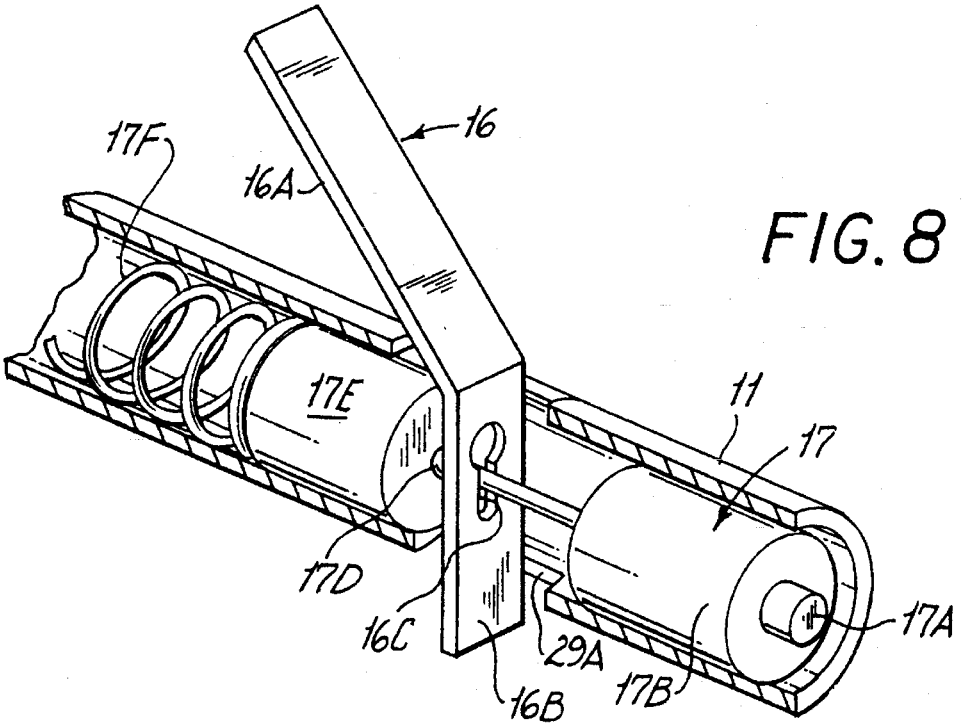
FIG. 8 is a close up perspective view in partial section of the right side adjustment handle portion of the device.

FIG. 5 shows an alternate, unhinged leg securement means utilizing a leg plate 25 sliding under bent tabs 26.

As shown in FIGS. 6–9, the appropriate means for the vertical adjustment of horizontal bar 11 includes trigger-release type handles 15 and 16 for adjusting horizontal bar 11 while the user is in the supine position facing up. For the vertical adjustment of horizontal bar 11, horizontal bar 11 includes oppositely positioned side end pin portions 17, which are insertable into respective apertures 12 within each of vertical frame bars 13 and 14.

Horizontal bar 11 may be inserted into vertical bars 13 and 14 by means of conventional pins, which pins are insertable within corresponding apertures 12 located within vertical frame bars 13 and 14. The apertures 12 correspond to various vertical placement locations for horizontal bar 11 along the inside vertical surfaces of vertical bars 13 and 14.

While horizontal bar 11 may be inserted into vertical bars 13 and 14 by means of conventional pins insertable within the corresponding apertures 12 located within vertical frame bars 13 and 14, horizontal bar 11 preferably contains finger operable trigger handles 15 and 16 on each side of horizontal bar 11, so that the user can squeeze trigger handles 15 and 16 with the fingers from above, to remove spring loaded extension pins 17, which extend into corresponding aperture holes 12 of vertical bars 13 and 14, while holding horizontal bar 11 with the palms of the hands of the user.

Spring loaded extension pins 17 of handles 15, 16 include outer projection 17A connected to body portion 17B, which is further connected at an opposite end thereof to inner projection connector 17C. Inner projection connector 17C includes movement restriction knob 17D, which movement restriction knob 17D holds inner projection connector 17C within respective grooves 15C, 16C of respective base portions 15B, 16B of respective trigger handle 15,16.

Extension pins 17 of handles 15, 16 rest in a closed position within apertures 12 of vertical bar 13. Pins 17 are urged within aperture 12 by means of springs 17F, which springs 17F urge filler plugs 17E against movement restriction knobs 17D of pins 17, thereby urging pins 17 within apertures 12 of vertical bars 13, 14 during stable use of horizontal bar 11 by the user while performing chinups or pull-ups from a supine position.

To release pins 17 from their locked position within apertures 12 of vertical bars 13,14, and thereby free horizontal bar 11 for vertical adjustment, trigger handles 15, 16 include manually operable trigger portions 15A and 16A of finger operable trigger handles 15 and 16. Each of trigger handles 15 and 16 also include respective base lever portions 15B and 16B connected to respective handle portions 15A, 16A. Respective base lever portions 15B, 16B are insertable within upper slots 11A, 11A' and lower slots 11B, 11B' respectively within horizontal bar 11. Manual downward pulling of trigger portions 15A and 16A urges base lever portions 15B and 16B against fulcrum points 28A and 29A, which fulcrum points 28A, 29A are located on the edge of lower slots 11B, 11B' closest to vertical bars 13 and 14 respectively. Base lever portions 15B and 16B are respectively rotatable about fulcrums 28A and 29A.

Each respective extension pin 17 is releasable from each respective aperture 12 in which it is inserted, upon the manual exertion of finger pressure upon trigger portions 15A and 16A, while the user holds horizontal bar 11 within the palms of the hands of the user. Consequently extension pins 17 are connected to respective trigger portion 15A or 16A by inner connection members 17C, so that extension pins 17 may move away from respective apertures 12, whereby the user can squeeze trigger handle 15 or 16 to remove respective spring loaded extension pin 17 from corresponding apertures 12 within vertical bars 13,14.

Each extension pin 17 is insertable into respective corresponding aperture 12 of vertical bar 13 or 14 upon release of finger operable trigger portion 15A or 16A, and the subsequent movement of extension pins 17 into apertures 12 within vertical bars 13, 14.

Thus downward compression of trigger handle portions 15A, 16A toward horizontal bar 11 causes retraction of exterior pins 17 from corresponding apertures 12 within vertical bars 13, 14, thus allowing horizontal bar 11 to be moved to a desired vertical position between bars 13, 14. Vertical movement of horizontal bar 11 can be accomplished by the user from a supine position.

The user can lie supine upon the base in the uninterrupted space between each vertical frame bar 13 and 14, and adjust the height of horizontal bar 11 according to the desired height for the user.

Moreover, because trigger handles 15, 16 are above horizontal bar 11, handles 15, 16 can be compressed down by the user's fingers while the user holds the bar 11 within the palms of the hands of the user.

Upright vertical bars 13 and 14 are secured to base 18 by preferable hinged panel members 19 and 20. After use of apparatus 10 by the user, upright vertical frame bars 13 and 14 may be folded down from a vertical position to a horizontal position, to rest vertical bars 13 and 14 flat against the horizontal plane of base 18, so that apparatus 10 can be easily stored or carried by a conventional handle or slot 30.

Apparatus 10 may be used as a therapeutic traction apparatus for enabling a person to apply gentle traction to the human spine by suspending the torso and head of the body by the arms while supporting some of the weight through the heels of the legs on the floor.

Therefore, apparatus 10 provides partial traction while the user lies supine on his or her back with the heels touching the ground, from a supine position, facing up with the heels of the user on the ground. The upper part of the body of the user may be gently pulled up or down in chin up or pullup movements by holding horizontal bar 11, which is selectively inserted within corresponding holes 12 of two parallel vertical bars 13 and 14.

Consequently, the user does not have to pull the entire body weight off of the ground in an undesirable hanging position which puts undue stress upon the neck, trapezius and deltoid muscles of the user.

In summary, the present invention provides exercise apparatus 10 used for doing modified pull-ups and chin-ups. Apparatus 10 is designed for use by a user in a supine position facing up with the heels of the user on the ground. Extension pins 17 of movable horizontal bar 11 are conveniently selectively inserted within respective aperture holes 12 of parallel vertical bars 13 and 14 while the user is in a supine position.

In order to avoid unnecessary changing of positions, the user can adjust the position of horizontal bar 11 from a supine position, by using in the preferred embodiment, the pair of trigger handles 15 and 16, which handles 15, 16 are located on each side of horizontal bar 11, so that the user can squeeze trigger handles 15 and 16 without moving the position of the hands away from horizontal bar 11, to release spring loaded extension pins 17, which extend into the corresponding aperture holes 12 within vertical bars 13 and 14.

While it is preferable to have extension pins 17 on both ends of horizontal bar 11, it is anticipated that a cantilvered version may be used, wherein at least one extension pin is insertable within at least one aperture of at least one vertical bar 13 or 14.

After use, apparatus 10 can be conveniently folded down for easy carrying. Horizontal chin-up/pull-up bar 11 is dismantled from vertical bars 13 and 14 and placed along the plane of flat base 18. Vertical bars 13 and 14 swivel down toward each other in a direction transverse to each lateral edge of base 18, and lock from the vertical to a horizontal position upon base 18 for easy storage and carrying of apparatus 10.

Various modifications may be made to the present invention without departing from the spirit and scope of the present invention, as noted in the appended claims.

I claim:

1. An exercise apparatus for allowing a user to perform at least one of a pull-up exercise and a chin-up exercise while lying supine on the user's back with the user's heel touching the ground, the apparatus comprising:

a base having a front edge, a rear edge and a pair of opposite lateral edges, said lateral edges extending between said front edge and said rear edge;

a movable horizontal bar, having a pair of ends;

a pair of substantially parallel frame bars removably connected to and extending in a substantially vertically direction from said base;

each of said frame bars having a plurality of slots located at a plurality of vertically spaced positions above said base, said slots corresponding to a plurality of vertical height locations for said movable horizontal bar above said base;

each of said frame bars being positioned along one of said opposite lateral edges approximately midway between said front edge and said rear edge;

said horizontal bar including a handle portion having a first diameter, a pair of end rod members each being provided at one end of said handle portion and each end rod member having a second diameter less than said first diameter and a pair of extension pins each extending from an end of one of said end rod members, each said extension pin having a third diameter greater than said second diameter;

said end rod members of said horizontal bar being selectively insertable within a pair of respective slots of said pair of frame bars at one of said plurality of vertical height locations above said base.

2. The foldable portable apparatus as in claim 1, wherein said vertical bars are connected by hinges to said base.

* * * * *